United States Patent [19]

Williams

[11] 4,451,248

[45] May 29, 1984

[54] CENTRIFUGE BOWL HAVING ROTOR WINDAGE LIMITED DISPOSED THEREON

[75] Inventor: John F. Williams, New Canaan, Conn.

[73] Assignee: E. I. Du Pont de Nemours and Company, Wilmington, Del.

[21] Appl. No.: 285,024

[22] Filed: Jul. 20, 1981

[51] Int. Cl.[3] ..... B04B 9/10

[52] U.S. Cl. ..... 494/84

[58] Field of Search ..... 233/1 R, 1 A, 1 C, 23 A, 233/24, 26, 13; 415/88, 90; 366/307; 494/60, 62, 16, 20, 84, 85; 68/23

[56] References Cited

U.S. PATENT DOCUMENTS

| | | | |
|---|---|---|---|
| 2,071,622 | 2/1937 | Gibson | 366/307 |
| 2,914,385 | 11/1959 | Massey | 366/307 |
| 2,986,916 | 6/1961 | Bochan | 68/23 |
| 3,265,369 | 8/1966 | Harrison | 366/307 |
| 3,273,865 | 9/1966 | White | 366/307 |
| 3,339,836 | 9/1967 | Mitchell et al. | 233/23 |
| 3,804,324 | 4/1974 | Sinn et al. | 233/24 |

FOREIGN PATENT DOCUMENTS

| | | |
|---|---|---|
| 112379 | 3/1976 | Japan . |
| 9865 | 4/1978 | Japan . |

*Primary Examiner*—Robert W. Jenkins

[57] ABSTRACT

The container for a centrifuge is characterized by at least one turbulence promoter mounted on the interior surface thereof at a predetermined operative height. The turbulance promoters serve to generate turbulent air flow about a rotor usable interchangeably within the container so as to windage limit the rotational speed of the rotor.

8 Claims, 3 Drawing Figures

CENTRIFUGE BOWL HAVING ROTOR WINDAGE LIMITED DISPOSED THEREON

BACKGROUND OF THE INVENTION

This invention relates to a container for a centrifuge apparatus and, in particular, to a container having a turbulence promoter on the internal surface thereof.

The containment vessel for a centrifuge apparatus is commonly called a container, or bowl. The container is supported within the centrifuge casing and is formed of a substantially cylindrical sidewall having a planar floor portion attached thereto. The container is provided with a central axial opening disposed through the floor. The shaft upon which the centrifuge rotor is received projects through the opening in the floor of the container. The shaft is driven by any suitable source of motive energy.

The rotor is disposed atop the shaft for rotation thereon within the confines of the container. Various sized rotors may be interchangeably mounted on the shaft. Each rotor is designed and configured to be windage limited. That is, the configuration of the rotor itself is designed to generate fluid frictional forces with the ambient fluid (air) within the container so that the speed of the rotor is limited to a predetermined maximum rated speed. Additionally, the electronics controlling the rotor drive is designed to include certain overspeed prevention features.

It may, however, be possible that a particular rotor when interchangeably mounted on the rotor shaft for use within a given container may not be physically configured to be windage limited within that particular container. If the safety features designed in the motor control electronics should fail an overspeed of the rotor used within the container may occur. This is perceived as disadvantageous in that the potentiality of a rotor burst is increased when a rotor is rotated above its predetermined maximum rated speed.

One solution to the possibility of rotor overspeed presented by the interchangeable use of various rotors within the same centrifuge container is to provide redundant electronic safety features which would minimize the risk of motor overspeed due to failure of the control electronics. However, precautionary measures in the form of redundant electronics are expensive.

Accordingly, it is believed advantageous to provide an arrangement within the container itself adapted to generate air flow conditions in the interior of the container which would assist in windage limiting the speed of any rotor utilized within the container.

SUMMARY OF THE INVENTION

This invention relates to a container or bowl for a centrifuge which may interchangeably receive any of a predetermined number of rotating elements for rotation therewithin. The container is formed of a cylindrical sidewall and a planar floor. The sidewall is provided on the internal surface thereof with at least one flow discontinuity or turbulence promoter operative to disrupt the air flow about a rotor rotatable within the container to thereby windage limit the rotational speed of the rotor. The discontinuities are preferably disposed at substantially diametrically opposed positions on the interior of the container and are arranged at a predetermined height along the sidewall thereof so as to impart a windage limiting effect to each of the predetermined plurality of rotors usable within the container.

BRIEF DESCRIPTION OF THE DRAWINGS

The invention will be more fully understood from the following detailed description thereof taken in connection with the accompanying drawings, which form a part of this application and in which.

DETAILED DESCRIPTION OF THE INVENTION

Figure 2:
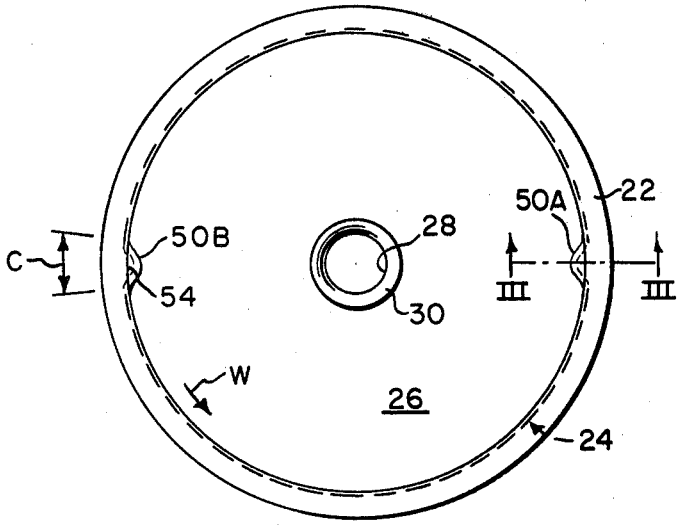
FIG. 2 is a plan view of the container shown in FIG. 1.

Throughout the following detailed description similar reference characters refer to similar elements in all Figures of the drawings.

Figure 3:
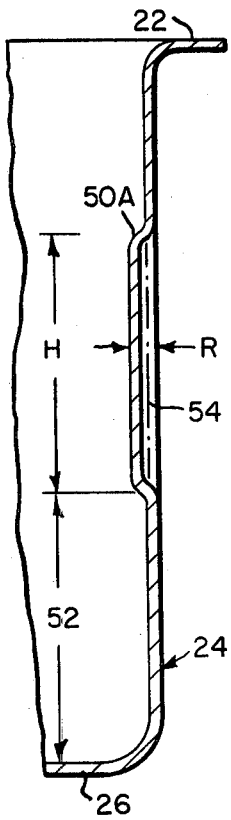
FIG. 3 is a side elevational view taken along section lines III—III of FIG. 2 illustrating in cross section the preferred form of turbulence promoter in accordance with the instant invention.
Figure 1:
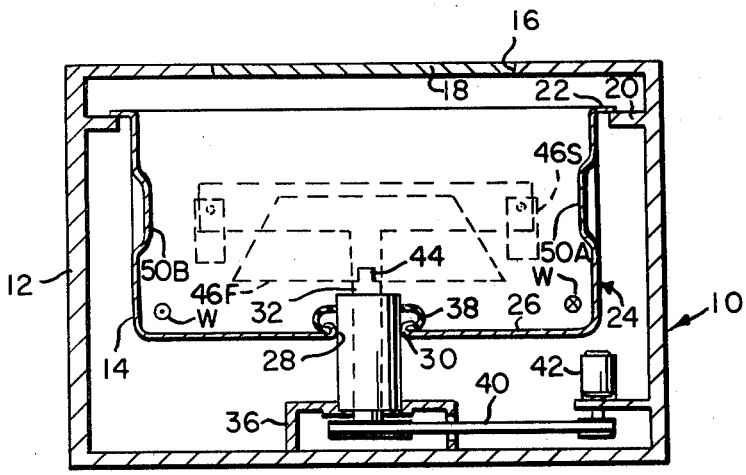
FIG. 1 is a side elevational view of a centrifuge container, having turbulence promoters disposed in accordance with the instant invention.

With reference to FIGS. 1 to 3 shown is a centrifuge generally indicated by reference character 10 having an outer casing 12 which completely surrounds a container or bowl 14. The casing 12 is provided with an access opening 16 through which rotating elements are inserted for centrifugation of their contents within the centrifuge 10. The access opening 16 is covered by a suitable door 18 when centrifugation is in progress. The container 14 is mounted within the casing 12 by any suitable support arrangement such as that shown in FIG. 1 in which the casing 12 has inwardly depending shoulders 20 which receive a lip or flange 22 disposed circumferentially about the top portion of the container 14. Of course, any suitable mounting arrangement may be utilized.

The container 14 is typically defined by a substantially cylindrical sidewall portion 24 having an annular floor or bottom 26 connected thereto. In practice, the sidewall 24 and the floor 26 are formed integrally one with the other by a stamping operation. Located centrally and axially of the floor 26 of the container 14 is an opening 28 defined by a curled back lip portion 30. The lip 30 extends upwardly into the volume defined on the container. The exterior surface of the sidewall 24 may be provided with impact absorbing shielding (not shown) and/or evaporator coils (not shown) if the centrifuge 10 is a refrigerated centrifuge.

Extending upwardly along the central axis of the container and projecting into the region or volume defined on the interior of the container 14 is a rotor shaft 32. The shaft 32 is supported by suitable bearings within a rotor gyro 34. The gyro 34 is supported from an abutment 36 mounted to the casing 12. A rubberized boot 38 received by the lip 30 closes the space between the lip 30 and the gyro 34.

Rotational force is imparted to the shaft 32 (and to a rotating element mounted thereon) connected by a pulley and belt 40 with a source of motive energy shown as a motor 42. The direction of rotor rotation is shown by the arrow W. The upper end portion of the shaft 32 is provided with a spud 44 adapted to receive thereon the central hub of a rotating element, or rotor, having a correspondingly configured central axial well therein. The rotor, when placed and secured to the spud 44, is thereby mounted for rotational movement within the container 14.

It is the practice in the art to interchangeably mount on the spud 44 of the shaft 32 any one of a predetermined number of rotor elements. For example, the centrifuge designated as the RT-6000 refrigerated tabletop centrifuge manufactured and sold by E. I. du Pont de Nemours and Company is adapted to receive either a fixed angle rotor 46F or, interchangeably, a swinging bucket centrifuge rotor 46S. Each of these rotors is shown in dot-dash lines in FIG. 1. Each rotor 46F and 46S is in itself designed with a physical configuration adapted to impart a windage limitation to the speed at which the rotor is able to rotate. However, it may occur that one particular rotor when mounted within a given container may be sized such that the inherent windage limitation imparted by its physical configuration is minimized. Thus the potentiality exists that if the electronic control associated with the motor fails the particular rotor may be rotated at a speed in excess of predetermined maximum rated speed.

In accordance with this invention at least one but preferably a pair of turbulence promoting elements 50A and 50B are disposed in substantially diametrically opposed positions on the interior surface of the sidewall 24 of the container 14. Any predetermined number of the turbulence promoting elements 50 may be used so long as the promoters 50 are symmetrically disposed about the interior of the container. As seen in FIG. 3 each of the turbulence promoters is a substantially radially inwardly directed protrusion having a height dimension H, a radial inward dimension R and a circumferential dimension C (FIG. 2). The turbulence promoters 50 are disposed at a predetermined operative height 52 above the floor of the container 14 to disrupt the air flow generated on the interior of the container by rotation of a rotor interchangeably usable therein. The operative height 52 at which the turbulence promoters 50 is disposed is a function of the physical size of the rotors which may be used in the containers 14. The operative height 52 is selected so that the turbulence promoters 50 perform the air flow disrupting function discussed herein so as to windage limit the speed of the rotors used in the container 14. Similarly, the dimensions H,R and C of the promoters 50 are selected so as to be compatible with the physical size of the various rotors interchangeably usable within the container 14.

The promoters 50 are preferably stamped integrally with the container although it is to be understood that any suitable arrangement may be made whereby the promoters are mounted to the sidewall and extend inwardly into the container. The promoters 50 are preferably mounted so that the axis 54 thereof lies parallel to the axis of the rotor shaft 32. That is, the axis 54 of each of the turbulence promoters 50 is vertical. However it should be understood that the axis 54 of each of the promoters 50 may be inclined with respect to vertical, either in the direction of rotor rotation or in a direction counter thereof. Moreover, the promoters 50 may be disposed in any desired and convenient shape so as to accomplish the windage limiting function discussed herein.

In operation any one of the predetermined number of rotors usable within the container is inserted on the spud 44 and rotated. Certain of the rotors may themselves be configured to windage limit their maximum rotational speed. However, it is possible that one of the rotors interchanged within the container may not be configured to itself physically limit its rotational speed. Accordingly, potentiality exists that if the motor control electronics fail the rotor may be rotated to a speed above the predetermined maximum rated speed. However, by having turbulence promoters 50 in accordance with this invention disposed on the interior of the container 14 the air flow associated with the rotation of the rotor within the container 14 is disrupted thus causing fluid friction effects which windage limit the speed at which that rotor may rotate.

Those skilled in the art having benefit of the teachings of the instant invention hereinabove set forth may effect numerous modifications thereto. These modifications are to be construed as contained within the scope of the instant invention as defined by the appended claims.

What is claimed is:

1. A container for a centrifuge comprising a sidewall and a floor, the sidewall having a first and a second inwardly directed turbulence promoter mounted thereto, each turbulence promoter having a predetermined height dimension H, a radial inward dimension R and a circumferential dimension C, the lower end of each of the promoters being disposed at a predetermined operative height above the floor so that a substantial portion of each turbulence promoter is radially adjacent to a centrifuge rotating element receivable within the container, the dimensions H, R and C and the operative height of each turbulence promoter being selected such that each turbulence promoter is sized so as to disrupt air flow generated within the container by the rotation of the rotating element to cause fluid friction effects whereby the speed at which the rotating element may rotate is windage limited.

2. The container of claim 1 wherein the first and the second turbulence promoters are substantially diametrically opposed.

3. The container of claims 1 or 2 wherein each of the turbulence promoters is integrally formed with the sidewall.

4. The container of claim 4 wherein the axis of each turbulence promoter is substantially vertical.

5. A centrifuge comprising a casing, a container mounted within the casing, the container having a sidewall and a floor, a rotatable shaft extending centrally and axially upwardly into the region defined by the container, the shaft being adapted to receive one of a predetermined number of rotating elements thereon, the container having a first and a second turbulence promoter disposed on the sidewall thereof and extending radially inwardly of the container, each turbulence promoter having a predetermined height dimension H, a radial inward dimension R and a circumferential dimension C, the lower end of each of the promoters being disposed at a predetermined operative height above the floor so that a substantial portion of each turbulence promoter is radially adjacent to the rotating element received on the shaft as that element is rotated, the dimensions H, R and C and the operative height of each turbulence promoter being selected such that each turbulence promoter being selected such that each turbulence promoter is sized so as to disrupt air flow generated within the container by the rotation of one of the rotating elements to cause fluid friction effects whereby the speed at which the rotating element may rotate is windage limited.

6. The centrifuge of claim 5 wherein the turbulence promoters are disposed substantially diametrically opposed from each other.

7. The centrifuge of claim 5 wherein each of the turbulence promoters are integrally formed with the sidewall.

8. The centrifuge of claims 6 or 7 wherein the axis of each turbulence promoter is substantially vertical.

* * * * *